United States Patent [19]

Wong

[11] 4,108,600

[45] Aug. 22, 1978

[54] FABRIC CONDITIONING ARTICLES AND PROCESSES

[75] Inventor: Louis Fay Wong, Fairfield, Ohio

[73] Assignee: The Procter & Gamble Company, Cincinnati, Ohio

[21] Appl. No.: 791,079

[22] Filed: Apr. 26, 1977

[51] Int. Cl.[2] ..... D06L 1/16; B05C 11/00

[52] U.S. Cl. ..... 8/137; 34/60; 222/129; 239/57; 239/60; 252/8.6; 252/90; 252/92; 427/242

[58] Field of Search ..... 8/137; 252/8.6, 90, 252/92; 427/242; 34/60; 239/60; 222/129

[56] References Cited

U.S. PATENT DOCUMENTS

| | | | |
|---|---|---|---|
| 3,633,538 | 1/1972 | Hoeflin | 118/76 |
| 3,676,199 | 7/1972 | Hewitt et al. | 427/242 |
| 3,945,936 | 3/1976 | Lucas et al. | 252/95 |
| 3,947,971 | 4/1976 | Bauer | 34/60 |
| 3,948,387 | 4/1976 | Haertle | 206/84 |
| 3,967,008 | 6/1976 | Mizuno et al. | 427/242 |

FOREIGN PATENT DOCUMENTS

| | | |
|---|---|---|
| 126008/75 | 10/1975 | Japan. |
| 98403/74 | 9/1974 | Japan. |
| 126930/73 | 1/1977 | Japan. |

*Primary Examiner*—John Kight, III

*Attorney, Agent, or Firm*—Douglas C. Mohl; George M. Kaplan; Richard C. Witte

[57] ABSTRACT

Fabric conditioning articles comprising a receptacle releasably containing a pH control agent or electrolyte, and fabric conditioning particles which have a coating of an agent which is insolubilized/made indispersible by the pH control agent or electrolyte. The pH control agent or electrolyte in such articles being separated from the fabric conditioning particles. Methods of using the articles are also provided.

24 Claims, No Drawings

FABRIC CONDITIONING ARTICLES AND PROCESSES

BACKGROUND OF THE INVENTION

The present invention relates to articles and methods for supplying conditioning benefits to fabrics in an automatic clothes washer and dryer. The articles comprise a receptacle releasably containing a fabric conditioning composition.

The home laundering operation can provide an opportunity to treat fabrics being laundered with a variety of materials which impart some desirable benefit or quality to the fabrics during laundering. At each stage of the laundering operation (presoaking, washing, rinsing, drying) fabrics are, to varying degrees, found in contact with water which can provide the medium for delivery of fabric conditioning agents.

Delivery of fabric conditioning agents to fabrics during the laundering operation is not, however, accomplished without certain difficulties. Surfactants are generally employed during the presoaking and washing steps for the purpose of removing materials (soil) from the fabrics. Simultaneous deposition onto fabrics of fabric conditioning agents can, therefore, prove troublesome. While some of these problems can be overcome by conditioning fabrics in the automatic dryer (see, for example, Gaiser; U.S. Pat. No. 3,442,692, issued May 6, 1969), it is nevertheless exceptionally difficult to achieve efficient deposition in the dryer of all fabric conditioning agents. For example, it is difficult for dryer added fabric softener/antistat compositions to match the softening performance of rinse added softeners.

Attempts have been made to improve the efficiency of conditioning agent fabric deposition during the laundering process. Some of the attempts are found in the prior art references listed subsequently herein. Included in such previous attempts are articles/compositions which rely on a film insolubilization/solubilization technique to control the release of fabric conditioning agents. Such executions are, however, not free from problems.

The present invention is based on the discovery that fabric conditioning articles which rely on the insolubilization/solubilization technique oftentimes exhibit poor release of the fabric conditioning agents to the fabrics. This has been found in part to be due to high concentrations of insolubilization agent (i.e., electrolyte or pH control agent) being present around certain parts of film which envelopes the fabric conditioner. This high concentration results in the film becoming insoluble and not allowing for optimum conditioner release. It has been found by the present inventor that the high localized concentration and the problems associated therewith can be overcome by physically separating the electrolyte or pH control agent from the film coated active. This separation can take many forms, as will be indicated hereinafter. Surprisingly, although the insolubilizing agent is separated from the film, the ability of the agent once in solution to insolubilize the film is not hindered. The net result is that the separation eliminates many negatives while allowing the fabric conditioning agent(s) to perform optimally.

Accordingly, it is an object of the present invention to provide articles which can be added to a clothes washer to condition fabrics in a superior manner concurrently with a washer and/or dryer operation. The articles are structured in a manner which overcomes many of the problems present in the prior art executions.

It is a further object herein to provide methods for conditioning fabrics during the home laundering process.

These and other objects will become obvious from the following disclosure.

DESCRIPTION OF THE PRIOR ART

U.S. Pat. No. 3,822,145, Liebowitz et al., FABRIC SOFTENING, issued July 2, 1974, relates to the use of spherical materials as fabric softening agents. U.S. Pat. No. 3,743,534, Zamora et al., PROCESS FOR SOFTENING FABRICS IN A DRYER, issued July 3, 1973; No. 3,698,095, Grand et. al., FIBER CONDITIONING ARTICLES, issued Oct. 17, 1972; No. 3,686,025, Morton, TEXTILE SOFTENING AGENTS IMPREGNATED INTO ABSORBENT MATERIALS, issued Aug. 22, 1972; No. 3,676,199, Hewitt et al., FABRIC CONDITIONING ARTICLE AND USE THEREOF, issued July 11, 1972; No. 3,633,538, Hoeflin, SPHERICAL DEVICE FOR CONDITIONING FABRICS IN DRYER, issued Jan. 11, 1972; No. 3,624,947, Furgal, COATING APPARATUS, issued Jan. 18, 1972; No. 3,632,396, Zamora, DRYER-ADDED FABRIC-SOFTENING COMPOSITIONS, issued Jan. 4, 1972; No. 3,442,692, Gaiser, METHOD OF CONDITIONING FABRICS, issued May 6, 1969; and No. 3,947,971, Bauer, FABRIC SOFTENER AND DISPENSER, issued Apr. 6, 1976, each related to articles and methods for conditioning fabrics in automatic dryers. U.S. Pat. No. 3,594,212, Ditsch, TREATMENT OF FIBROUS MATERIALS WITH MONTMORILLONITE CLAYS AND POLYAMINES AND POLYQUATERNARY AMMONIUM COMPOUNDS relates to the treatment of fibrous materials with clays and amine or ammonium compounds.

Granular detergent compositions containing fabric conditioning materials are disclosed in U.S. Pat. No. 3,862,058, Nirschl et al., DETERGENT COMPOSITIONS CONTAINING A SMECTITE-TYPE CLAY AND SOFTENING AGENT, issued Jan. 21, 1975; U.S. Pat. No. 3,861,870, Edwards et al., FABRIC SOFTENING COMPOSITIONS CONTAINING WATER INSOLUBLE PARTICULATE, issued Jan. 21, 1975; and Japanese Publication No. 1924/77, Washing Assistants, published Jan. 19, 1977.

SUMMARY OF THE INVENTION

The instant invention is based on the discovery that superior fabric conditioning articles can be prepared by releasably placing an effective amount of fabric conditioning particles which have as a coating a film which has its solubility controlled by pH or electrolyte level within a receptacle having at least a part of one wall made of a water-insoluble, porous material. Also enclosed within said receptacle is an amount of a pH control agent of electrolyte sufficient to insolubilize said film. Further, the film coated particles are separated from the insolubilizing agent in said receptacles by forming separate parts by sealing one part of the receptacle off from the other; coating the film coated particles with a water-soluble film which is not affected by the level of pH control agent/ electrolyte present in the article; or by separating the receptacle into two parts by means of a wall which may be water-insoluble/indispersible and permeable or impermeable or water-soluble and not affected as indicated above for the film. The water soluble materials should not completely dissolve until the pH control agent/electrolyte had dissolved in the wash water.

In its process aspect, this invention encompasses a process for conditioning fabrics comprising combining an article of the type disclosed above with a load of fabrics in a clothes washer and leaving the article with the fabrics through the wash/rinse cycle of the washer and the drying cycle of an automatic clothes dryer. Alternatively, the article may remain with the fabrics through all the cycles of an automatic washer and be discarded at the end of that time if an automatic dryer is not used and the fabrics are air dried.

DETAILED DESCRIPTION OF THE INVENTION

The articles herein comprise multiple components each of which is described, in turn, below.

Receptacle

The receptacle which contains the coated particles and the pH control agent and/or electrolyte in the present invention is a closed article wherein at least a part of one wall is constructed of a material which is water-insoluble and indispersible and is sufficiently porous to allow for the release of the pH control agent and/or electrolyte during the wash cycle and the fabric conditioning composition during the rinse cycle and in the dryer. The remainder of the receptacle can then be any water-insoluble/indispersible, porous or nonporous material.

Since it is desirable to make the articles herein as aesthetically pleasing as possible and inasmuch as the articles are to be used in a clothes washer and an automatic clothes dryer, it is preferred that the porous wall of the receptacle be both water-insoluble and heat resistant. Therefore, the receptacle herein can be made of any materials meeting these requirements. The wall can be made, for example, of porous materials such as open weave cotton, polyester, and the like, cloth or foams.

In a preferred receptacle herein, the porous wall or walls in an elastic, open cell foam or elastic nonwoven material. The open cell foams are distinguished from closed cell foams in that the closed cell structure substantially isolates the individual cells while the open cell structure does not. Regardless of what material is used, it should not inhibit the release of the receptacle's contents.

Open cell foams can be made from polystyrene, polyurethane, polyethylene, polyvinyl chloride, cellulose acetate, phenolformaldehyde and other materials such as cellular rubber. Many of these materials and their method of manufacture are disclosed in standard references such as *Encyclopedia of Polymer Science and Technology*, Interscience Publishers, John Wiley & Sons, Inc. (1965), incorporated herein by reference.

The preferred nonwoven cloth materials used herein can generally be defined as adhesively bonded fibrous or filamentous products having a web or carded fiber structure (where the fiber strength is suitable to allow carding), or comprising fibrous mats in which the fibers or filaments are distributed haphazardly or in random array (i.e., an array of fibers in a carded web wherein partial orientation of the fibers is frequently present, as well as a completely haphazard distributional orientation), or substantially aligned. The fibers or filaments can be natural (e.g., wool, silk, jute, hemp, cotton, linen, sisal, or ramie) or synthetic (e.g., rayon, cellulose ester, polyvinyl derivatives, poly-olefins, polyamides, or polyesters). Preferred materials include polyesters, polyamides, poly-olefins and polyvinyl derivatives and mixtures of these with rayon or cotton to achieve the desired elasticity.

Methods of making nonwoven cloths are not a part of this invention and, being well known in the art, are not described in detail herein. Generally, however, such cloths are made by air- or water-laying processes in which the fibers or filaments are first cut to desired lengths from long strands, passed into a water or air stream, and then deposited onto a screen through which the fiber-laden air or water is passed. The deposited fibers or filaments are then adhesively bonded together, dried, cured, and otherwise treated as desired to form the nonwoven cloth. Nonwoven cloths made of polyesters, polyamides, vinyl resins, and other thermoplastic fibers can be spun-bonded, i.e., the fibers are spun out onto a flat surface and bonded (melted) together by heat or by chemical reactions.

Especially preferred materials for preparing the above-described wall of the article herein are open pore polyurethane foams and spun-bonded nonwoven cloths, especially those made from polyesters. The polyurethane foams preferably have a density of from about 0.02 g/cm$^3$ to about 0.04 g/cm$^3$ while the polyester has a basis weight of about 10 g/sq.yd. to 90 g/sq.yd. The thickness of this wall can vary depending on the aesthetic properties desired by the manufacturer, but will preferably be from about 0.2 cm to about 4 cm for polyurethane and from about 0.01 cm to about 6 cm for polyester. The air permeability of the porous wall need only provide sufficient porosity to allow for the release of the fabric conditioning composition but is preferably in the range of 700 to 1400 cubic feet per minute per square foot of surface. The air permeability is measured according to ASTM Method D737-69, "Standard Method of Test for Air Permeability of Textile Fabrics."

It is also within the scope of the present invention to provide articles wherein the receptacle is made of more than one layer of the above-described materials. For example, two layers of nonwoven polyester may be selected to provide articles having an appearance which connotes optimum fabric conditioning.

pH Control Agent and/or Electrolyte

Achieving the superior fabric conditioning performance described hereinbefore is dependent on the fabric conditioning composition not being released until the rinse cycle of the clothes washer and during the drying cycle of the clothes dryer. As a result of this release pattern, the consumer can have the convenience of putting the article in with the fabrics to be washed at the start of the wash cycle while obtaining, for example, softening/antistatic performance which is superior to that delivered by rinse cycle or dryer added softeners/antistats.

The insolubility of the particle coating in the present articles during the wash cycle is achieved by maintaining a sufficiently high electrolyte level and/or proper pH in wash solution. The electrolyte level and/or pH are critical since, looking at the former first, the electrolyte either through a chemical reaction or salting out mechanism may cause the particle coating material to gel or precipitate (hereinafter both referred to as "gel") and, hence, be water-insoluble. Once the electrolyte level drops below the gelling level (i.e., when the wash water containing the electrolyte is removed and replaced with clean rinse water), the particle coating can begin to dissolve/disperse, thereby releasing the fabric conditioning composition which it surrounds. The obtaining of efficient gelling in many instances is dependent on the electrolyte residing in an environment having a pH within a certain range. The pH allows the electrolyte to complex with the coating material in the most efficient manner. This is especially true where the electrolyte has an anion which can be protonated within a pH range encountered by the articles herein. If protonation occurs gelation is hindered. Therefore it is necessary in such instances to maintain the pH of the wash solution above th $pK_A$ of the anion.

Many materials are insolubilized solely as the result of pH control. The critical pH is generally thought to be around the isoelectric point and can be achieved through the use of pH control agents. Examples of such agents will be discussed herein later.

The materials which can serve as electrolytes in the present invention are any of those materials which are solid and can sufficiently complex or salt out the coating material to cause it to gel or precipitate. Examples of suitable agents include but are not limited to sodium borate, sodium metaborate, ammonium sulfate, sodium sulfate, potassium sulfate, zinc sulfate, cupric sulfate, ferrous sulfate, magnesium sulfate, aluminum sulfate, potassium aluminum sulfate, ammonium nitrate, sodium nitrate, potassium nitrate, aluminum nitrate, sodium chloride, potassium chloride, sodium phosphate, potassium chromate, potassium citrate and mixtures thereof.

The amount of electrolyte employed herein is an amount sufficient to gel the particle coatings. This can be determined by dispersing/dissolving a small amount, for example, about 0.5 grams, of the coating material in a known quantity of about 32° C wash solution and then adding the electrolyte until reversible gelation occurs. This amount can then be increased to maintain the molar concentration of the electrolyte in the wash water at the gelation level for the total amount of water present. For most washers a water volume of 64 to 83 liters, on an average about 70 liters, is present during the wash cycle. Therefore, the amount of electrolyte to be used in the articles herein should be sufficient to maintain the concentration at the gelation level in 70 liters of water. Thus, if one liter of water is used to determine gelation, the amount of electrolyte for use in the article would be 70 times that amount. The wash bath solutions in which the articles herein are used will contain detergent compositions and these will affect the solubility of the particle coatings. Therefore, to the liter of water should be added a detergent composition at a concentration equivalent to normal wash conditions. Since there are two basic types of laundry detergents, liquids and granules, two tests should be conducted. In one test about 0.9 ml. of a liquid detergent should be dissolved in the water prior to electrolyte addition and in the other test about 4.5 ml. of a granule detergent should be dissolved. These amounts correspond to 1/4 cup of liquid detergent per wash load and 1¼ cup of granules. The amount of electrolyte/pH control agent used in the articles herein is the greater of the two amounts determined to be required for gelation. This amount insures that the article is operable in all types of wash solutions. Of course, it is to be appreciated that the critical factor is the electrolyte concentration in the wash solution and not how it is achieved. (i.e., If more than one article is used the total amount of electrolyte used must be enough to insolubilize or make indispersible the particle coatings). All of the electrolyte can be present in one article or split between the articles as explained hereinafter.

As is ture with the electrolyte component of the present invention, the pH control agent can be any of a wide variety of solid acids, bases and general buffering systems. Included among such materials are citric acid, glycolic acid, tartaric acid, maleic acid, gluconic acid, boric acid, glutamic acid, isophthalic acid, sodium bisulfate, potassium bisulfate, sodium hydroxide, potassium hydroxide and alkali metal and ammonium phosphate, carbonates, borates, bicarbonates and metaborates. A preferred electrolyte/pH control agent is sodium metaborate. It is to be appreciated that waters of hydration may be present on any of the agents which are hydratable (e.g., borax).

The amount of pH control agent used herein is an amount sufficient to insure the insolubility/indispersibility of the particle coating. This will vary with the particular material selected but can easily be determined in the manner described above for the electrolyte.

It is oftentimes advantageous to coat the electrolyte/pH control agent with a material to reduce the dustiness which such agents may possess when in powder form. Materials which are suitable for this use include water-soluble nonionics such as ethoxylated alcohols.

Fabric Conditioner Particle Coating

The particle coating, as explained herein previously, serves to prevent the fabric conditioning composition from being released to the fabrics until preferably the rinse cycle of the washer and the drying cycle of the dryer. The coating material must therefore be water-soluble or dispersible but be insolubilized/made indispersible during the wash cycle by the maintenance of a sufficient electrolyte level and/or the appropriate pH. Materials which satisfy this requirement are many and will be discussed hereinbelow.

The materials which can be used for the particle coating herein include polyvinyl alcohol, gelatins and other proteins, polyvinyl pyrrolidone, polyethylene oxide, methyl cellulose, hydroxypropyl methyl cellulose, polyfructose, and polysaccharides such as guar gum, among many others including derivatives and mixtures of these materials. The coating can have a broad range of molecular weights and amount to varying weight percentages of the total particle weight. However, it is preferred that the former be from about 2,000 to about 200,000 and the latter be from about 0.1 to about 50%. These limitations provide for particle coatings which can most effectively dissolve/disperse to release the fabric conditioning composition.

The materials listed above can be grouped by the type of agent required to make the material insoluble and indispersible. Those which are controlled by electrolyte level include polyvinyl alcohol, polyethylene oxide, methyl cellulose, guar gum, and hydroxypropyl methyl cellulose. Those which are controlled by pH include gelatin and other proteins, polyvinyl pyrrolidone and polyfructose.

The preferred materials for use as the particle coating are polyvinyl alcohol and gelatins. The polyvinyl alcohol preferably has a degree of hydrolysis of from about 73% to about 100% more preferably about 88%, and a molecular weight of about 2,000 to 130,000, preferably about 90,000. The gelatin materials can be either Type A, isoelectric point of pH 7–9, or Type B, isoelectric point of pH 4.7 – 5. The gelation of gelatin takes place near the isoelectric point. A detailed discussion of polyvinylalcohol can be found in C. A. Finch (Editor), *Polyvinyl Alcohol — Properties and Applications,* John Wiley & Sons, New York, 1973. Detailed discussions of proteins can be found in H. R. Mahler & E. H. Cordes, *Biological Chemistry,* Harper and Row, New York, 1971, and A. H. Lehninger, *Biochemistry,* Worth Pub., Inc., New York, 1975. Discussions of the previously mentioned cellulose derivatives, polyvinyl pyrrolidone and ethylene oxide are found in R.L. Davidson & M. Sittig (Editors), *Water-Soluble Resins,* Van Nostrand Reinhold Company, New York, 1968. A discussion of polysaccharides is found in R. L. Whistler (Editor), *Industrial Gums — Polysaccharides and Their Derivatives,* American Press, New York, 1973. All of these references are incorporated herein by reference.

Fabric Conditioning Composition

For purposes of the present invention a "fabric conditioning agent" is any substance which improves or modifies the chemical or physical characteristics of the fabric being treated therewith. Examples of suitable fabric conditioning agents include perfumes, elasticity improving agents, flame proofing agents, pleating agents, antistatic agents, soil release agents, softening agents, soil proofing agents, water repellent agents, crease proofing agents, acid repellent agents, antishrinking agents, heat proofing agents, coloring material, brighteners, bleaching agents, fluorescers and ironing aids. These agents can be used alone or in combination.

The most preferred fabric conditioning agents for use in the present invention are fabric softener/antistat agents. Such agents provide benefits sought by many consumers and the convenience offered by the present invention would serve them well.

The fabric softener/antistat agents employed herein are most generally any of the wide variety of water-insoluble nonionic and cationic materials known to supply these benefits. These materials are substantive, and have a melting point within the range of from about 20° to about 115° C, preferably within the range of from about 30° to about 60° C.

The most common type of cationic softener/antistat materials are the cationic nitrogen-containing compounds such as quaternary ammonium compounds and amines having one or two straight-chain organic groups of at least eight carbon atoms. Preferably, they have one or two such groups of from 12 to 22 carbon atoms. Preferred cation-active softener compounds include the quaternary ammonium softener/antistat compounds corresponding to the formula

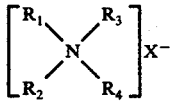

wherein $R_1$ is hydrogen or an aliphatic group of from 1 to 22 carbon atoms; $R_2$ is an aliphatic group having from 12 to 22 carbon atoms; $R_3$ and $R_4$ are each alkyl groups of from 1 to 3 carbon atoms; and X is an anion selected from halogen, acetate, phosphate, nitrate and methyl sulfate radicals.

Because of their excellent softening efficacy and ready availability, preferred cationic softener/antistat compounds of the invention are the dialkyl dimethyl ammonium salts wherein the alkyl groups have from 12 to 22 carbon atoms and are derived from long-chain fatty acids, such as hydrogenated tallow. As employed herein, alkyl is intended as including unsaturated compounds such as are present in alkyl groups derived from naturally occurring fatty oils. The term "tallow" refers to fatty alkyl groups derived from tallow fatty acids. Such fatty acids give rise to quaternary softener compounds wherein $R_1$ and $R_2$ have predominantly from 16 to 18 carbon atoms. The term "coconut" refers to fatty acid groups from coconut oil fatty acids. The coconut-alkyl $R_1$ and $R_2$ groups have from about 8 to about 18 carbon atoms and predominate in $C_{12}$ to $C_{14}$ alkyl groups. Representative examples of quaternary softeners of the invention include tallow trimethyl ammonium chloride; ditallow dimethyl ammonium chloride; ditallow dimethyl ammonium methyl sulfate; dihexadecyl dimethyl ammonium chloride; di(hydrogenated tallow) dimethyl ammonium chloride; dioctadecyl dimethyl ammonium chloride; dieicosyl dimethyl ammonium chloride; didocosyl dimethyl ammonium chloride; di(hydrogenated tallow) dimethyl ammonium methyl sulfate; dihexadecyl diethyl ammonium chloride; dihexadecyl dimethyl ammonium acetate; ditallow dipropyl ammonium phosphate; ditallow dimethyl ammonium nitrate; di(coconut-alkyl) dimethyl ammonium chloride.

An especially preferred class of quaternary ammonium softener/antistats of the invention correspond to the formula

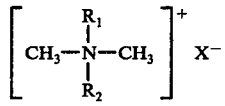

wherein $R_1$ and $R_2$ are each straight chain aliphatic groups of from 12 to 22 carbon atoms and X is halogen, e.g., chloride or methyl sulfate. Especially preferred are ditallow dimethyl ammonium methyl sulfate (or chloride) and di(hydrogenated tallow-alkyl) dimethyl ammonium methyl sulfate (or chloride) and di(coconut-alkyl) dimethyl ammonium methyl sulfate (or chloride), these compounds being preferred from the standpoint of excellent softening properties and ready availability.

Suitable cation-active amine softener/antistat compounds are the primary, secondary and tertiary amine compounds having at least one straight-chain organic group of from 12 to 22 carbon atoms and 1,3-propylene diamine compounds having a straight-chain organic group of from 12 to 22 carbon atoms. Examples of such softener actives include primary tallow amine; primary hydrogenated-tallow amine; tallow 1,3-propylene diamine; oleyl 1,3-propylene diamine; coconut 1,3-propylene diamine; soya 1,3-propylene diamine and the like.

Other suitable cation-active softener/antistat compounds herein are the quaternary imidazolinium salts. Preferred salts are those conforming to the formula

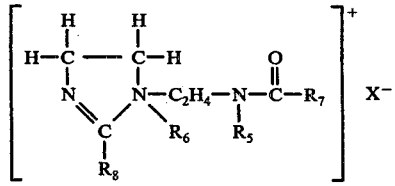

wherein $R_6$ is an alkyl containing from 1 to 4, preferably from 1 to 2 carbon atoms, $R_5$ is an alkyl containing from 1 to 4 carbon atoms or a hydrogen radical, $R_8$ is an alkyl containing from 1 to 22, preferably at least 15 carbon atoms or a hydrogen radical, $R_7$ is an alkyl containing from 8 to 22, preferably at least 15 carbon atoms, and X is an anion, preferably methylsulfate or chloride ions. Other suitable anions include those disclosed with reference to the cationic quaternary ammonium fabric softener/antistats described hereinbefore. Particularly preferred are those imidazolinium compounds in which both $R_7$ and $R_8$ are alkyls of from 12 to 22 carbon atoms, e.g., 1-methyl-1-[(stearoylamide)ethyl]-2-heptadecyl-4,5-dihydroimidazolinium methyl sulfate; 1-methyl-1-[(palmitoylamide)ethyl]-2-octadecyl-4,5-dihydroimidazolinium chloride and 1-methyl-1-[(tallowamide) ethyl]-2-tallow-imidazolinium methyl sulfate.

Other cationic quaternary ammonium fabric softener/antistats which are useful herein include, for example, alkyl ($C_{12}$ to $C_{22}$)-pryidinium chlorides, alkyl $C_{12}$ to $C_{22}$)-alkyl ($C_1$ to $C_3$)-morpholinium chorides and quaternary derivatives of amino acids and amino esters.

Nonionic fabric softener/antistat materials include a wide variety of materials including sorbitan esters, fatty alcohols and their derivatives, diamine compounds and the like. One preferred type of nonionic fabric antistat/-softener material comprises the esterified cyclic dehydration products of sorbitol, i.e., sorbitan ester. Sorbitol, itself prepared by catalytic hydrogenation of glucose, can be dehydrated in well-known fashion to form mixture of cyclic 1,4- and 1,5-sorbitol anhydrides and small amounts of isosorbides. (See Brown; U.S. Pat. No. 2,322,821; issued June 29, 1943) The resulting complex mixtures of cyclic anhydrides of sorbitol are collectively referred to herein as "sorbitan." It will be recognized that this "sorbitan" mixture will also contain some free uncyclized sorbitol.

Sorbitan ester fabric softener/antistat materials useful herein are prepared by esterifying the "sorbitan" mixture with a fatty acyl group is standard fashion, e.g., by reaction with a fatty ($C_{10}$–$C_{24}$) acid or fatty acid halide. The esterification reaction can occur at any of the available hydroxyl groups, and various mono-, di-, etc., esters can be prepared. In fact, complex mixtures of mono-, di-, tri-, and tetra-esters almost always result from such reactions, and the stoichiometric ratios of the reactants can simply be adjusted to favor the desired reaction product.

The foregoing complex mixtures of esterified cyclic dehydration products of sorbitol (and small amounts of esterified sorbitol) are collectively referred to herein as "sorbitan esters." Sorbitan mono- and di-esters of lauric, myristic, palmitic, stearic and behenic acids are particularly useful herein for conditioning the fabrics being treated. Mixed sorbitan esters, e.g., mixtures of the foregoing esters, and mixtures prepared by esterifying sorbitan with fatty acid mixtures such as the mixed tallow and hydrogenated palm oil fatty acids, are useful herein and are economically attractive. Unsaturated $C_{10}$–$C_{18}$ sorbitan esters, e.g., sorbitan mono-oleate, usually are present in such mixtures. It is to be recognized that all sorbitan esters, and mixtures thereof, which are essentially water-insoluble and which have fatty hydrocarbyl "tails," are useful fabric softener/antistat materials in the context of the present invention.

The preferred alkyl sorbitan ester fabric softener/antistat materials herein comprise sorbitan monolaurate, sorbitan monomyristate, sorbitan monopalmitate, sorbitan monostearate, sorbitan monobehenate, sorbitan dilaurate, sorbitan dimyristate, sorbitan dipalmitate, sorbitan distearate, sorbitan dibehenate, and mixtures thereof, the mixed coconutalkyl sorbitan mono-and di-esters and the mixed tallowalkyl sorbitan mono- and di-esters. The triand tetra-esters of sorbitan with lauric, myristic, palmitic, stearic and behenic acids, and mixtures thereof, are also useful herein.

Another useful type of nonionic fabric softener/antistat material encompasses the substantially water-insoluble compounds chemically classified as fatty alcohols. Mono-ols, di-ols, and poly-ols having the requisite melting points and water-insolubility properties set forth above are useful herein. Such alcohol-type fabric conditioning materials also include the mono- and di-fatty glycerides which contain at least one "free" OH group.

All manner of water-insoluble, high melting alcohols (including mono- and di-glycerides), are useful herein, inasmuch as all such materials are fabric sustantive. Of course, it is desirable to use those materials which are colorless, so as not to alter the color of the fabrics being treated. Toxicologically acceptable materials which are safe for use in contact with skin should be chosen.

A preferred type of unesterified alcohol useful herein includes the higher melting members of the so-called fatty alcohol class. Although once limited to alcohols obtained from natural fats and oils, the term "fatty alcohols" has come to means those alcohols which correspond to the alcohols obtainable from fats and oils, and all such alcohols can be made by synthetic processes. Fatty alcohols prepared by the mild oxidation of petroleum products are useful herein.

Another type of material which can be classified as an alcohol and which can be employed as the fabric softener/antistat material in the instant invention encompasses various esters of polyhydric alcohols. Such "ester-alcohol" materials which have a melting point within the range recited herein and which are substantially water-insoluble can be employed herein when they contain at least one free hydroxyl group, i.e., when they can be classified chemically as alcohols.

The alcoholic di-esters of glycerol useful herein include both the 1,3-di-glycerides and the 1,2-di-glycerides. In particular, di-glycerides containing two $C_8$–$C_{20}$, preferably $C_{10}$–$C_{18}$, alkyl groups in the molecule are useful fabric conditioning agents.

Non-limiting examples of ester-alcohols useful herein include: glycerol-1,2-dilaurate; glycerol-1,3-dilaurate; glycerol-1,2-dimyristate; glycerol-1,3-dimyristate; glycerol-1,2-dipalmitate; glycerol-1,3-dipalmitate; glycerol-1,2-distearate and glycerol-1,3-distearate. Mixed glycerides available from mixed tallowalkyl fatty acids, i.e., 1,2-ditallowalkyl glycerol and 1,3-ditallowalkyl glycerol and 1,3-ditallowalkyl glycerol, are economically attractive for use herein. The foregoing ester-alcohols are preferred for use herein due to their ready availability from natural fats and oils.

Mono- and di-ether alcohols, especially the $C_{10}$–$C_{18}$ di-ether alcohols having at least one free -OH group, also fall within the definition of alcohols useful as fabric softener/antistat materials herein. The ether-alcohols can be prepared by the classic Williamson ether synthesis. As with the ester-alcohols, the reaction conditions are chosen such that at least one free, unetherified -OH group remains in the molecule.

Ether-alcohols useful herein include glycerol-1,2-dilauryl ether; glycerol-1,3-distearyl ether; and butane tetra-ol-1,2,3-trioctanyl ether.

Yet another type of nonionic fabric conditioning agent useful herein encompasses the substantially water-insoluble (or dispersible) diamine compounds and diamine derivatives. The diamine fabric conditioning agents are selected from the group consisting of particular alkylated or acylated diamine compounds.

Useful diamine compounds have the general formula

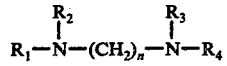

wherein $R_1$ is an alkyl or acyl group containing from about 12 to 20 carbon atoms; $R_2$ and $R_3$ are hydrogen or alkyl of from about 1 to 20 carbon atoms and $R_4$ is hydrogen, $C_{1-20}$ alkyl or $C_{12-20}$ acyl. At least two of $R_2$, $R_3$ and $R_4$ are hydrogen or alkyl containing 1 to 3 carbon atoms, and $n$ is from 2 to 6.

Non-limiting examples of such alkylated diamine compounds include:

$C_{15}H_{31}-N(CH_3)-(CH_2)_3-N(CH_3)_2$ $C_{18}H_{37}-N(CH_3)-(CH_2)_2-N(C_2H_5)_2$ $C_{12}H_{25}-N(CH_3)-(CH_2)_3-HN-C_{12}H_{25}$ $C_{12}H_{25}-N(C_2H_5)-(CH_2)_3-N(C_3H_7)_2$ $R_{\overline{Tallow}}NH-(CH_2)_3-N(C_2H_5)_2$ $C_{20}H_{41}-N(CH_3)-(CH_2)_2-N(CH_3)_2$ $C_{15}H_{31}-N(C_2H_5)-(CH_2)_3-NH_2$ $C_{18}H_{37}-NH-(CH_2)_3-HN-CH_3$ $C_{16}H_{33}-NH-(CH_2)_3-HN-C_{16}H_{33}$ $R_{\overline{Tallow}}N(CH_3)-(CH_2)_3-N(C_2H_5)_2$ $C_{16}H_{33}N(CH_3)-(CH_2)_5-N(C_2H_5)_2$ $C_{12}H_{25}N(C_2H_5)-(CH_2)_2-N(C_3H_7)_2$ and $C_{14}H_{29}N(CH_3)-(CH_2)_3(CH_3)N-C_8H_{17}$ wherein in the above formulas $R_{Tallow}$ is the alkyl group derived from tallow fatty acid.

Other examples of suitable aklyated diamine compounds include N-tetradecyl, N'-propyl-1,3-propanediamine, N-eicosyl,N,N',N'-triethyl-1,2-ethane-diamine and N-octadecyl,N,N',N'-tripropyl-1,3-propane-diamine.

Examples of suitable acylated diamine fabric softener/antistat materials include $C_{13-20}$ amido amine derivatives.

The fabric softener/antistats mentioned above can be used singly or in combination in the practice of the present invention.

Preferred mixtures useful herein are mixtures of dialkyl dimethyl ammonium salts with imidazolinium salts and mixtures of these two materials with sorbitan esters. An especially preferred mixture includes ditallow dimethyl ammonium methyl sulfate and 1-methyl-1-[(tallowamide)ethyl]-2-tallow imidazolinium methyl sulfate in a ratio of from about 100:0 to about 0:100 and sorbitan tristearate in a ratio of from about 50:50 to about 5:95, sorbitan tristearate to the sum of the other two agents. Tallow alcohol or hydrogenated castor oil may be used to replace sorbitan tristearate in the above mixture with similar results being obtained. Another especially preferred mixture includes the above mixture wherein the sorbitan tristearate is absent and the other two components are present in a ratio of from about 100:0 to 0:100.

Another class of desirable fabric conditioning agents useful in the articles herein are bleaches. These include the common inorganic peroxy compounds such as alkali metal and ammonium perborates, percarbonates, monopersulfates and monoperphosphates. Solid, organic peroxy acids, or the water-soluble, e.g., alkali metal, salts thereof of the general formula

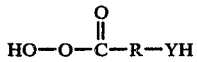

wherein R is a substituted or unsubstituted alkylene or arylene group and Y is

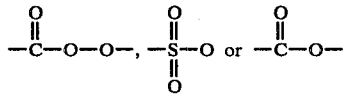

or any other group which yields an anionic group in aqueous solution are also useful herein. These bleaches are more fully described in U.S. Pat. No. 3,749,673, July 31, 1973, Jones et al., incorporated herein by reference.

OPTIONAL COMPONENTS

In a preferred article herein the fabric conditioning particles are made of softener/antistat agents. In addition to the softener/antistat agents the preferred particles herein can also optionally contain minor proportions (i.e., 0.01% to about 15% by weight of the total particle composition) of various other ingredients which provide additional fabric conditioning benefits. Such optional ingredients include perfumes, fumigants, bactericides, fungicides, optical brighteners and the like. Specific examples of typical solid, water-soluble additives useful herein can be found in any current Year Book of the American Association of Textile Chemists and Colorists. Such additional components can be selected from those compounds which are known to be compatible with the softener/antistat agents employed herein.

A preferred optional ingredient is a fabric substantive perfume material. Inlcuded among such perfume materials are musk ambrette, musk ketone, musk xylol, ethyl vanillin, musk tibetine, coumarin, aurantiol and mixtures thereof. The above perfumes are preferably used in an amount of from about 0.1% to about 5% by weight of the total particle composition.

The water-soluble silicate materials recognized in the art as corrosion inhibitors can be employed in the present compositions at levels of about 5% by weight.

Separation of Electrolyte/pH Control Agent from Film Coated Fabric Conditioner Particles The present inventor has discovered that, unless the electrolyte/pH control agent (insolubilizing agent) is separated from the film coated fabric conditioner particles, the film tends to become very insoluble due to the occlusion of the insolubilizing agent. The separation can take many forms with the only requirement being that the separation allow the insolubilizing agent to be released to the wash water and dissolved before it makes contact with the film coating the fabric conditioning agent particles. Several methods of separation are given below.

The first method is to simply put the electrolyte/pH control agent into a separate receptacle from the one containing the fabric conditioning agent. With this execution the two receptacles form a kit with both receptacles being used simultaneously in the wash bath. The receptacle containing the electrolyte/pH control agent is constructed in the same manner and from the same materials described hereinbefore for the receptacle holding both the electrolyte/pH control agent and the fabric conditioning particles. Additionally, the receptacle containing only the insolubilizing agent may be constructed in part of a water-soluble material which is not affected by the level of pH control agent/electrolyte present in the receptacle. Such materials include polyethylene oxide, cellulose derivatives and polyvinyl pyrrolidone, among many others.

The preferred separation of the actives in the present invention involves having a single receptacle with the separating barrier being provided within the receptacle. The separation can be obtained by sealing one part of the receptacle off from the other by means of sewing, sonic sealing, gluing or some other similar means, the material used for gluing or sewing may be water-insoluble or water-soluble and dissolve after the insolubilizing agent has escaped; inserting an additional wall within the receptacle, which wall is constructed of a water-insoluble material which is impermeable or permeable and having a porosity of less than 300 cubic feet per minute per square foot of surface area (cfm) or a water-soluble material. Also the separation may be accomplished by placing a coating of a water-soluble material around the film coated fabric conditioning particles. The water-insoluble impermeable or permeable material can be any of those mentioned hereinbefore for the walls of the receptacle. The impermeable nature can be obtained by a simple selection of materials. The same is true of the material having a permeability of less than 300 cfm. This degree of permeability allows for the electrolyte/pH control agent to escape from the receptacle before coming into contact with the fabric conditioning particles. The fabric conditioner is, however, able to move through the wall and utilize all of the porous surface of the receptacle to escape into the rinse water of the washer.

The water-soluble material which can be used to construct the additional wall can be any of a wide variety of materials not affected by the level of pH control agent or electrolyte present in the article. Such materials include polyvinyl pyrrolidone, polyethylene oxide, carboxymethyl cellulose and other cellulose derivatives. Additionally the wall may be constructed of a water insoluble web which has its openings filled with a material such as polyethylene glycol. These same materials can be used to form a coating around the film coated particles. This coating takes the place of the wall and like the wall will dissolve after the electrolyte/pH control agent has escaped from the receptacle into the wash water.

The water-soluble materials can have molecular weight in the range indicated hereinbefore for the film which is insolubilized by the pH control agent/electrolyte (i.e. 2,000 to about 200,000). When in the form of a wall the thickness is preferably from about 0.1 mil. to about 5 mil. When used as a coating the material preferably amounts to from about 0.1% to about 50%, more preferably from about 3% to about 10%, by weight of the coated fabric softener/antistat particle.

PREPARATION AND USAGE

The articles of the present invention are prepared by fashioning a receptacle of the type hereinbefore described and enclosing therein an effective amount of the film coated fabric conditioning particles. By an "effective amount" of the fabric conditioning particles herein is meant an amount sufficient to condition an average load of fabrics in an automatic washer/dryer. Of course, the actual amount of the fabric conditioning particles employed will depend on the fabric load and the particular agents selected for use in the article. For example, when an average 5 lbs. to 8 lbs. load of fabrics is being treated, from about 1 gram to 12, preferably 1 to 6, grams of any of the foregoing softener/antistat agents provide good fabric conditioning. The lower level is acceptable for use herein due to the ability of the articles of this invention to protect the conditioning agent from being lost during the washing process. The particles may be formed in any convenient manner. A preferred method is to form prills by spraying a melt of the actives into a cooled, closed tower.

The fabric conditioning particles are coated with the film capable of being insolubilized/made indispersible by pH or electrolyte level. This coating can be applied to individual particles or preferably agglomerates of particles by techniques which are well known in the art. For example with the preferred PVA coating material the particles can be sprayed with an aqueous PVA coating in a closed coating cannister in which the coating agent is sprayed onto a fluid bed of the conditioner particles.

Agglomeration is a well-known granule formation technique and can be undertaken in any convenient, conventional manner. Generally, an aqueous slurry, solution, or melt of an agglomerating medium is prepared and sprayed into an agitated dry mixture of the conditioning agent. Other solvents such as ethanol may also be used with the agglomerating agent. The agglomerating/coating materials may contain plasticizers such as glycerol to make them more flexible.

Since it is desirable to retain the coated particles or agglomerates within the receptacle until the rinse cycle or the dryer cycle, the size of particles should be selected such that the particles in coated form are larger than the openings in the receptacle walls (generally from about 200 to about 1500 microns). The particles-/agglomerates, once the coating is removed, should be small enough to pass through the porous walls or capable of easily breaking into smaller particles which can pass through the porous portion of the receptacle (generally from about 40 to about 120 microns).

The receptacle herein can be provided in a variety of sizes and shapes and the particular configuration of the receptacle is not critical to the practice of this invention. For example, the receptacle herein can be provided wherein only one wall, or a portion of one wall, comprises the materials described previously herein. Preferably the whole of the receptacles comprise and described materials.

In its simplest and preferred aspect, the receptacle herein is prepared in the shape of a pouch. The receptacle in the preferred articles comprises a nonwoven polyester cloth having an air permeability of from about 700 to about 1400 cubic feet per minute per square foot. In one preferred execution the receptacle is formed by sealing three edges of the material by heat, glue, sewing or sonic sealing, leaving an opening along one edge. The fabric conditioner particles in this preferred embodiment are coated with polyvinyl alcohol and subsequently coated with a thin coating of polyethylene glycol or polyethylene oxide. The coated particles and the electrolyte insolubilizing agent are added to the receptacle which then has its fourth edge sealed.

In another preferred embodiment herein the above-described pouch is split into two parts by sonic sealing or conventional sewing. The coated particles, again preferably coated with polyvinyl alcohol, are placed into one half of the pouch and the electrolyte/pH control agent is placed into the other half. The pouch is then completely sealed.

In yet another preferred embodiment herein the pouch, rather than being split as described above, has an additional wall placed within it to split the pouch. This additional wall is preferably made of polyester and possesses an air permeability of less than 300 cfm. Into one half are placed the fabric conditioner particles while the electrolyte/pH control agent is placed into the other half.

As was noted hereinbefore, the size of the present articles is not critical and can be whatever the manufacturer desires. For ease of handling, however, it is preferred that the receptacle be from about 2 inches × 3 inches to about 4 inches × 6 inches.

The preferred pH control agent/electrolyte for use with the polyvinyl alcohol coated particles is a sodium borate or sodium borate/metaborate system sufficient to provide a molar boron concentration of from about $1 \times 10^{-3}$ to about $2 \times 10^{-2}$ and a pH greater than 8.5, preferably 9.0 – 9.5 in the wash water.

Usage

The articles of the present invention can be utilized in a variety of ways depending on the desires of the user. In a preferred process, an article prepared as described herein is placed in with a load of fabrics at the start of the wash cycle in a standard clothes washer and left with the fabrics through the entire wash, rinse and spin drying cycles. The temperature of the wash and rinse waters can be any temperatures desired by the user, but generally are in the range of from about 4° to about 60° C. The article then reamins with the damp fabrics when they are placed in the drum of an automatic clothes dryer, if a dryer is used. The dryer is operated in standard fashion to dry the fabrics, usually at a temperature from about 50° to about 80° C for a period of from about 10 to about 60 minutes, depending on the fabric load and type. Alternatively, the articles herein can be combined with the fabrics at the start of the wash cycle and removed with the fabrics at the end of the rinse cycle when a dryer is not used.

The detergent composition which can be used to wash the fabrics during the above-described wash cycle can be any conventional detergent composition. Such a composition generally contains from about 1 to about 50% of a detersive surfactant. The detergents may be liquid or solid and contain other components such as a detergency builder, bleaches, enzymes, among detergency adjuvants. The surfactants which may be used include any of the common anionic, nonionic, ampholytic and zwitterionic detersive agents well known in the detergency arts. Mixtures of surfactants may also be used. Examples of surfactants are given in U.S. Pat. No. 3,717,630, Booth, Feb. 20, 1973, and No. 3,443,880, Kessler et al., July 25, 1967, each incorporated herein by reference.

The detergency builder salts which are oftentimes utilized in detergent compositions include both inorganic, as well as organic, water-soluble builder salts and the various water-insoluble and so-called "seeded" builders. Typical laundry detergent compositions are designed to provide a concentration of builder salt of from about 50 ppm to about 1000 ppm and a concentration of detersive surfactant in the range of 50 ppm to about 1000 ppm. These concentrations are generally met in the average aqueous solutions used to wash fabrics (5–25 gallons). The amount of detergent composition utilized per wash load is familiar to users of laundry products and ranges from about ¼ cup to 1¼ cup.

The performance delivered by the receptacles herein when used as described above is equivalent to a rinse added liquid softener in terms of softness and a dryer added sheet in terms of static control.

All percentages and ratios used herein are by weight unless otherwise designated.

The invention will be further illustrated by the following nonlimiting examples:

EXAMPLES I

An article of the present invention in the form of a pouch is made in the following manner:

A. One hundred parts of a particulate fabric softener-/antistat composition comprising 20% sorbitan tristearate and 80% ditallowdimethylammonium methylsulfate are agglomerated with one part of polyvinyl alcohol, 88% hydrolyzed, medium viscosity and plasticized with 0.1 part glycerol, and subsequently coated with two parts of the same polyvinyl alcohol which is also plasticized with 0.2 parts of glycerol. The fabric softenerantistant particles are formed by spraying a melt of the softener/antistat into a cooled tower to form prills. The prills are then sprayed with a solution comprising 8% of polyvinyl alcohol, 0.8% glycerol, 50% ethanol and 41.2% water in an agglomerating/coating cannister.

B. A pouch measuring 3 inches × 4-½ inches is formed with walls having two polyester layers, one layer having a basis weight of 20 grams/sq. yd. and the other being air laid and having a basis weight of 45 grams/sq. yd.

C. The pouch of (B) is bonded on three edges, two long edges and one short, using an ultrasonic sewing machine.

D. To the sealed pouch of (C) is added 10 grams of sodium tetraborate decahydrate and 15 grams of sodium metaborate octahydrate.

E. The part of the pouch of (D) containing the salts is sealed using a thread stitching.

F. Six grams of the coated fabric softener/antistat composition of (A) is added to the pouch of (E), with the unsealed end being sealed with an ultrasonic sewing machine.

A similar article to that described above is made but the borate and metaborate salts are not separated from the coated active.

EXAMPLE II

The pouches of Example I are added to separate automatic washers along with a 5.5 lb. bundle of unsoiled fabrics and 96 grams of an anionic detergent. The washers are operated for 14 minutes using 32° C temperature water. After the completion of the wash cycle, the rinse cycle using 32° C water and the spin dry cycles are completed. The two fabric loads along with the pouches are placed into separate dryers which are operated for a period of 50 minutes at a normal temperature setting. Three aditional treatments identical to those described above are also conducted.

The results of all treatments show that the articles of the present invention deliver superior softness and static control as determined by tactile evaluation and visual observation.

EXAMPLE III

An article of the present invention in the form of a pouch is made as described in Example I for the split pouch. However, in this instance the pouch is not split, by sealing into two parts. Rather, the separation is achieved by inserting a layer of nonwoven polyester, having a basis weight of 48 grams/sq. yd. and an air permeability of 250 cfm, between the double layered walls. The fabric softener composition is then placed on one side of the dividing wall and the borate/metaborate salt mixture is placed on the other side. The pouch is sealed by ultrasonic means as described in Example I.

When the above-described article is tested as described in Example II, it delivers fabric softness and static control superior to that delivered by the pouch having no physical separation of the actives.

EXAMPLE IV

An article of the present invention in the form of a pouch is made as described in Example I for the split pouch. However, in this instance the pouch is not split into two parts. The physical separation is achieved by coating the polyvinyl alcohol (PVA) coated particles with polyethylene glycol having a molecular weight of about 4000. The amount of such coating applied is 5% of the total weight of the PVA and the softener/antistat composition. The softener/antistat particles and the borate, metaborate salts are added together to the pouch and the fourth edge is sealed.

When the above-described article is tested as described in Example II, it delivers fabric softness and static control superior to that delivered by the pouch having no physical separation of the actives. Similar results are obtained when the polyethylene glycol coating has a molecular weight of 20,000.

In the above described Examples, the softener/antistat components can be replaced by other nonionics and cationics with similar results being achieved. Included among these other materials are sorbitan monostearate, tallow alcohol, imidazolinium salts and mixtures of imidazolinium salts and uncyclized quaternary ammonium salts such as ditallowdimethylammonium methylsulfate.

What is claimed is:

1. A fabric conditioning article especially designed for conditioning fabrics in a clothes washer and dryer comprising:

(A) a water-insoluble, closed receptable having at least a part of one wall comprising a porous material;

(B) an effective amount of a fabric conditioning composition in the form of individual or agglomerated particles, said particles being coated with a water-soluble/dispersible material and enclosed within the receptacle of (A); and (C) an amount of a solid, particulate agent selected from the group consisting of electrolytes, pH control agents and mixtures thereof sufficient to make the coatings of (B) water-insoluble/indispersible in the volume of wash water in which they are used, said agent enclosed within the receptacle of (A);

wherein the agent of (C) is physically separated from the particles of (B) within the receptacle of (A).

2. An article according to claim 1 wherein the porous part of the receptacle of (A) is selected from the group consisting of open cell foams and nonwoven materials.

3. An article according to claim 2 wherein the receptacle of (A) is in the form of a pouch.

4. An article according to claim 3 wherein both walls are porous

5. An article according to claim 4 wherein the fabric conditioning composition is a fabric softener/antistat composition.

6. An article according to claim 5 wherein the fabric softener/antistat composition contains a fabric softener-/antistat agent selected from the group consisting of cationic agents, nonionic agents and mixtures thereof.

7. An article according to claim 6 wherein the physical separation is accomplished by splitting the pouch of (A) into two parts through the use of a sealing agent and placing the particles of (B) into one part and the agent of (C) into the other.

8. An article according to claim 7 wherein the sealing agent is selected from the group consisting of glue, thread and heat.

9. An article according to claim 6 wherein the physical separation is accomplished by coating the particles of (B) with a water-soluble, nonionic material which is not affected by the level of pH control agent or electrolyte present in the article.

10. An article according to claim 9 wherein the water-soluble, nonionic material is selected from the group consisting of polyethylene glycol, carboxymethyl cellulose and polyethylene oxide.

11. An article according to claim 6 wherein the coating material on the particles of (B) is selected from the group consisting of polyvinyl alcohol, gelatin and other proteins.

12. An article according to claim 11 wherein the coating material is polyvinyl alcohol having a degree of hydrolysis of from about 77% to about 100%.

13. An article according to claim 12 wherein the agent of (C) is an electrolyte selected from the group consisting of sodium borate, sodium metaborate, ammonium sulfate, sodium sulfate, potassium sulfate, zinc sulfate, cupric sulfate, ferrous sulfate, magnesium sulfate, aluminum sulfate, potassium aluminum sulfate, ammonium nitrate, sodium nitrate, potassium nitrate, aluminum nitrate, sodium chloride, potassium chloride, sodium phosphate, potassium chromate, potassium citrate, sodium carbonate, potassium carbonate, and mixtures thereof.

14. An article according to claim 13 wherein the electrolyte is selected from the group consisting of sodium borate, sodium metaborate and mixtures thereof.

15. An article according to claim 14 wherein the fabric softener/antistat composition contains a mixture of ditallowdimethylammonium methylsulfate and 1-methyl-1-[(tallowamide) ethyl]-2-tallowimidazolinium methylsulfate in a ratio of from about 100:0 to about 0:100.

16. An article according to claim 15 wherein the fabric softener/antistat composition additionally contains sorbitan tristearate in a ratio of from about 50:50 to about 5:95, sorbitan tristearate to the total amount of ditallowdimethylammonium methylsulfate and 1-methyl-1-[(tallowamide)ethyl]-2-tallowimidazolinium methylsulfate.

17. A fabric conditioning article in kit form especially designed for conditioning fabrics in a clothes washer and dryer comprising:

(A) a water-insoluble, closed receptacle having at least a part of one wall comprising a porous material;

(B) an effective amount of a fabric conditioning composition in the form of individual or agglomerated particles, said particles being coated with a water-soluble/dispersible material and enclosed within the receptacle of (A);

(C) a second closed receptacle having at least a part of one wall comprising a porous material or a water-soluble material; and (D) an amount of a solid, particulate agent selected from the group consisting of electrolytes, pH control agents and mixtures thereof sufficient to make the coatings of (B) water-insoluble/indispersible in the volume of wash water in which they are used, said agent enclosed within the receptacle of (C).

18. An article according to claim 17 wherein both receptacles are in the form of pouches having walls made of a material selected from the group consisting of nonwoven materials and open cell foams.

19. An article according to claim 18 wherein the fabric conditioning composition is a fabric softener/antistat composition.

20. A process for conditioning fabrics comprising the following steps:

(A) adding to a clothes washer, along with the fabrics to be washed and a normal amount of a detergent, a fabric conditioning article according to Claim 1; and (B) operating said washer at normal operating conditions through the wash and rinse cycles.

21. A process according to claim 20 wherein the following steps are added:

(C) the washed fabrics and fabric conditioning article from step (B) are transferred to a clothes dryer; and (D) said dryer is operated for an effective period of time at dryer operating conditions.

22. A process according to claim 21 wherein the porous part of the receptacle of (A) is selected from the group consisting of open cell foams and nonwoven materials.

23. A process according to claim 22 wherein the receptacle of (A) is in form of a pouch and both walls are porous.

24. A process according to claim 23 wherein the fabric conditioning composition is a fabric softener/antistat composition containing a fabric softener/antistat agent selected from the group consisting of a cationic agents, nonionic agents and mixtures thereof.

* * * * *